US005293998A

United States Patent [19]

George

[11] Patent Number: 5,293,998

[45] Date of Patent: Mar. 15, 1994

[54] CONTAINER WITH CHAIN RETAINING OPENING

[75] Inventor: Richard A. George, Winona, Minn.

[73] Assignee: Peerless Chain Company, Winona, Minn.

[21] Appl. No.: 883,525

[22] Filed: May 15, 1992

[51] Int. Cl.[5] ..... B65D 83/00

[52] U.S. Cl. ..... 206/525; 206/388; 206/527; 211/71; 221/303

[58] Field of Search ..... 206/388, 389, 409, 525-527; 211/71; 221/303, 312 C, 312 R

[56] References Cited

U.S. PATENT DOCUMENTS

| | | | |
|---|---|---|---|
| D. 276,890 | 12/1984 | Hancher . | |
| D. 283,796 | 5/1986 | Schuster . | |
| D. 304,296 | 10/1989 | Wilson et al. . | |
| 1,826,084 | 10/1931 | Mohr . | |
| 1,859,871 | 5/1932 | Harlan | 211/71 |
| 2,144,534 | 1/1939 | Hedquist et al. | 211/71 |
| 2,491,652 | 12/1949 | Feerick | 211/71 |
| 2,579,131 | 12/1951 | Tinsley . | |
| 3,173,386 | 3/1965 | Magers . | |
| 3,375,918 | 4/1968 | Platky . | |
| 3,556,293 | 1/1971 | Schlueter . | |
| 3,765,344 | 10/1973 | Ferdinand et al. . | |
| 4,006,854 | 2/1977 | Gibson et al. . | |
| 4,070,823 | 1/1978 | Schreyer et al. . | |
| 4,094,416 | 6/1978 | Smith | 211/71 |
| 4,181,218 | 1/1980 | Cox | 206/409 |
| 4,289,262 | 9/1981 | Finkelstein . | |
| 4,583,642 | 4/1986 | Blythe et al. . | |
| 4,645,108 | 2/1987 | Gavin et al. . | |
| 4,682,699 | 7/1987 | Ertley | 211/71 |
| 4,775,052 | 10/1988 | Moore et al. | 211/71 |
| 5,038,689 | 8/1991 | Duffy . | |

FOREIGN PATENT DOCUMENTS

| | | | |
|---|---|---|---|
| 2624106 | 6/1989 | France | 221/312 R |
| 0076747 | 6/1981 | Japan | 206/525 |

OTHER PUBLICATIONS

A Lehigh Cordage, Inc. brochure, entitled "The New Lehigh . . . Chain Merchandising System . . . Far Above All Others", 8 pages (Exhibit AA).

A Laclede Chain Manufacturing Company brochure, entitled "Hardware & Industrial Chain HC8601", 5 pages (Exhibit BB).

Exhibit AA-1 page document re containers with circular openings and container retaining shelf system.

Exhibit BB-8 page document, entitled "ideas, program, impact, advantage, points", by Columbus McKinnon Corporation, labelled Jan. 1992, copyrighted 1992.

*Primary Examiner*—Jimmy G. Foster

*Attorney, Agent, or Firm*—Merchant, Gould, Smith, Edell, Welter & Schmidt

[57] ABSTRACT

The present invention relates to a container with a chain retaining opening. The container includes a side wall which defines an enclosed chamber for receiving a length of chain. An opening provides access to the enclosed chamber from an exterior of the container. The opening is sized to permit the free passage of the chain from the enclosed chamber to dispense the chain from the container. The opening includes structure for retaining the chain from free passage from the enclosed chamber when dispensing of the chain is not desired. The retaining structure includes at least one narrowed passage which defines a cross-sectional opening smaller than the widest part of the chain and larger than the smallest portion of the chain. When the chain is positioned in the narrowed passage, the chain cannot be dispensed from the container. A sloped surface provides a gravity feed from the opening to the narrowed passage. A second narrowed passage on an opposite side of the container adjacent the opening has a different shaped passage. A similar sloped surface slopes to the second narrowed passage. One narrowed passage is U-shaped and one is V-shaped. The container includes a body portion and a lid portion, with the lid portion including the opening and the various narrowed passages.

22 Claims, 8 Drawing Sheets

CONTAINER WITH CHAIN RETAINING OPENING

FIELD OF THE INVENTION

The present invention relates to systems and methods for containing and dispensing chain. In particular, the present invention relates to a container and system for selectively dispensing chain.

BACKGROUND OF THE INVENTION

Chain is sometimes maintained for storage or display in a single length, which is then dispensed into shorter segments of chain of selected lengths cut from the longer length of chain. One concern relating to display and storage of lengths of chain includes maintaining the length of chain in an organized manner.

In the past, chain has been dispensed from spools or reels rotatably mounted to a support structure. These spools may be difficult to handle and to replace when emptied.

Other concerns for storage and display of chain include whether the chain is easy to view and to access during display and storage. In the case of retail sales of chain, there is a concern of maintaining the merchandise in an aesthetically pleasing manner.

More recent dispensing systems use containers having a circular or semicircular opening for the chain to flow through. These containers are more aesthetically pleasing. However, even these systems encounter the problem of the chain length flowing through the opening excessively.

There is a need in the prior art for containers and systems for use in containing and dispensing chain that address the above concerns and other concerns.

SUMMARY OF THE INVENTION

The present invention relates to a container with a chain-retaining opening. The container stores the chain and includes a side wall which defines an enclosed chamber for receiving a length of chain. A main opening in the side wall provides access to the enclosed chamber from an exterior of the container to dispense the chain from the container. The main opening is sized to permit selected chain flow from the enclosed chamber during dispensing of the chain from the container. The main opening includes structure for restricting chain flow from the enclosed chamber when dispensing of the chain is not desired. The retaining structure helps keep the chain from spilling out onto the ground during storage when a portion of the chain hangs from the container.

The retaining structure includes at least one narrowed passage which defines a slot having a substantial portion with a horizontal width which is smaller than the widest portion of the stored chain and larger than the smallest portion of the chain. When the chain is positioned in the narrowed passage, the flow of the chain from the container is limited.

A sloped surface provides a bias to feed the chain from the main opening to the narrowed passage when the chain is placed on the sloped surface and allowed to fall downward.

A second narrowed passage on an opposite side of the container adjacent the main opening preferably has a different-shaped passage. Another sloped surface slopes to the second narrowed passage. One narrowed passage is preferably a U-shaped slot and one is preferably a V-shaped slot, permitting usage of the container with a variety of different chains. Chain types which do not work well with one of the narrowed passages having one size or shape may work better with the other narrowed passage.

In the preferred embodiment, the container includes a body portion and a lid portion, with the lid portion including the main opening and the various narrowed passages. The lid includes an inwardly facing projection which engages a groove on the body to mount the lid to the body.

The present invention also relates to a system of storage and display of chain including an enclosure structure for engagement with a shelf structure. The shelf structure has a top surface. The enclosure structure includes a fence having a front rail and a pair of side rails extending from the front rail on opposite ends of the front rail. Structure is provided for securing the fence to the shelf structure. A plurality of containers may be provided to be received by a storage chamber formed by the top surface of the shelf structure and the enclosure structure. The containers are received in single row relationship on the shelf. In the preferred embodiment, each of the containers includes a top surface including a handle to permit easy handling of the container.

BRIEF DESCRIPTION OF THE DRAWINGS

In the drawings, wherein like reference numerals generally indicate corresponding parts throughout the several views.

DETAILED DESCRIPTION OF THE PREFERRED EMBODIMENT

Figure 1:
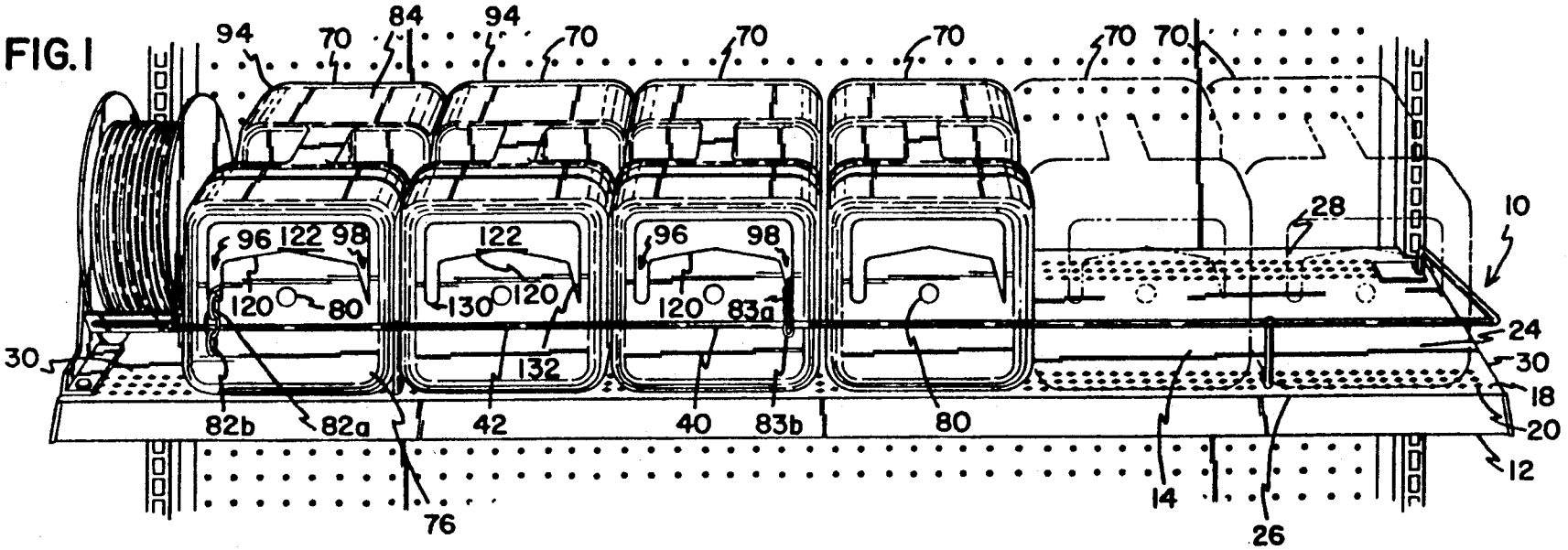
FIG. 1 is a perspective view of a preferred embodiment of a system according to the present invention including an enclosure structure, a shelf structure, and a plurality of containers.
Figure 2:
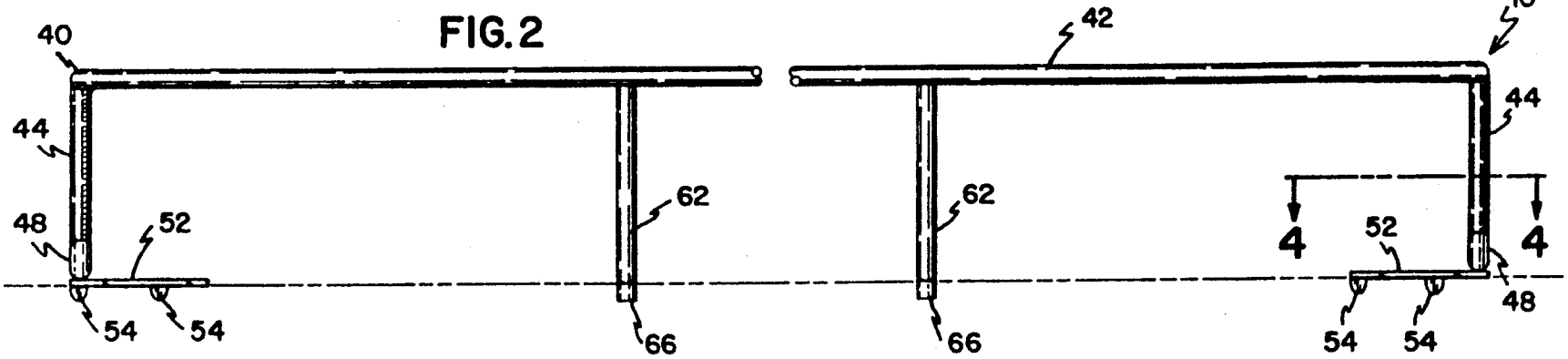
FIG. 2 is a front view of the enclosure structure shown in FIG. 1.
Figure 3:
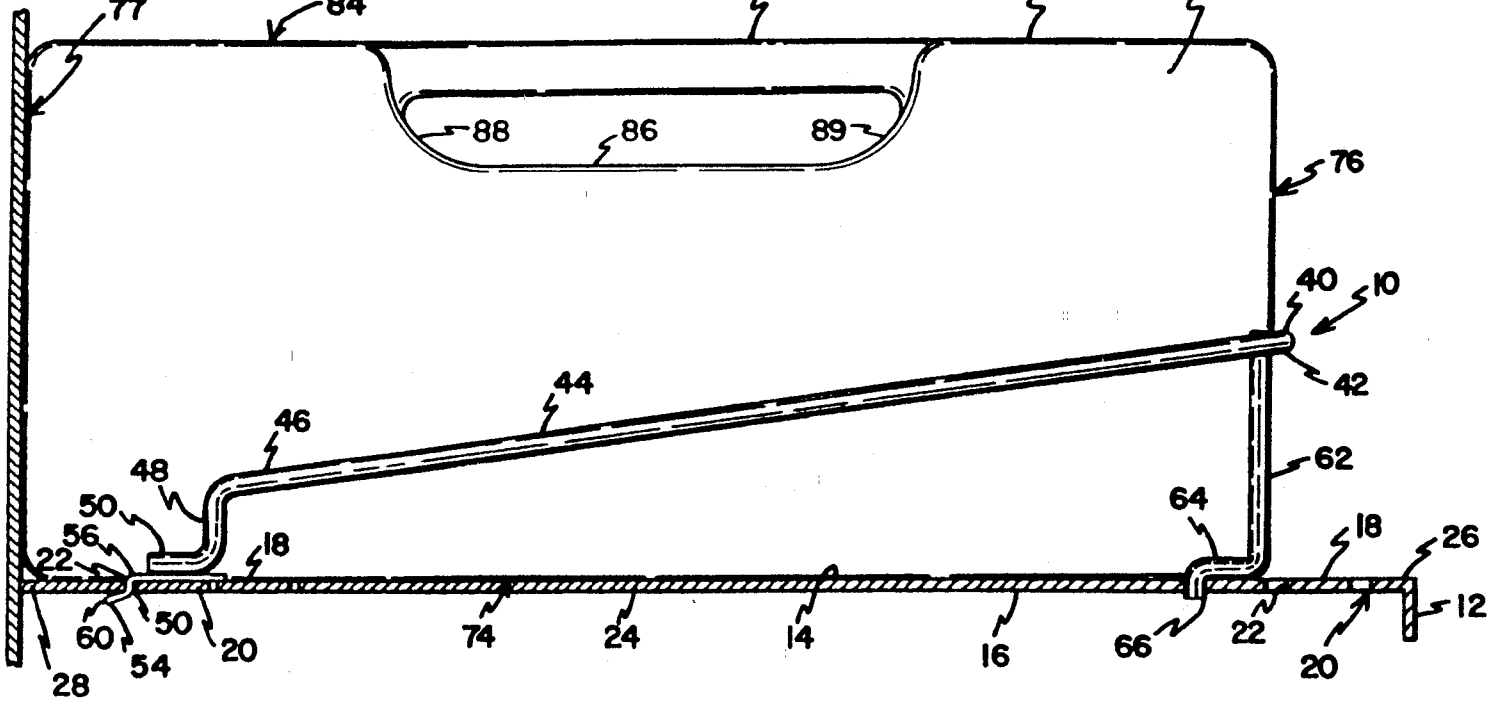
FIG. 3 is a side view of the enclosure structure of FIG. 2, showing the enclosure structure engaging the shelf structure and one of the containers positioned on the shelf structure and having a portion surrounded by the enclosure structure.

Referring now to FIGS. 1–4, an enclosure structure 10 is shown engageable with a shelf structure 12 for storage and display of individual containers 70. Containers 70 are used to store and dispense chain, such as first chain 82*a* and second chain 83*a*. As shown in FIG. 1, an enclosure structure 10 is positioned on a top surface 14 of shelf structure 12. A bottom surface 16 of shelf structure 12 is disposed vertically beneath top surface 14, as is best shown in FIG. 3 Top surface 14 includes a planar portion 24 adapted to support the containers 70. Shelf structure 12 includes a front edge 26, a back edge 28, and side edges 30 which surround the planar portion 24 of top surface 14.

In the preferred embodiment, each container 70 is configured to receive a length of chain to be dispensed into segments cut from the remaining length in the interior of the container. As shown in FIG. 1, each of the openings 120 are sized to dispense a length of chain such as first chain 82*a* or second chain 83*a* when the containers 70 are positioned in a shelf system. Such a system is useful in retail stores, where customers desire a particular length of chain. The customer, or a sales clerk, pulls from the appropriate container 70 a desired length of chain. Once a desired length of chain is removed from the container 70, the chain is cut into a segment, leaving most of the remainder of the chain within the interior of the container for future dispensing, with an end portion hanging downwardly from the container. Chain retaining structure 96,98 associated with each container 70 limits dispensing of chain as necessary. Retaining structure 96,98 is particularly useful to prevent gravity from pulling sufficiently on the free ends 82*b*,83*b* of chain to pull more chain from the container down onto the ground.

Referring now to FIGS. 2 and 3, enclosure structure 10 comprises a fence member or fence 40. Fence 40 includes an elongated front rail 42 and two side rails 44 extending from the front rail 42 on opposite ends of the front rail. Each of the side rails 44 terminates in a distal end 46. The side rails 44 and the front rail 42 cooperate to form a generally U-shaped continuous fence 40.

As best shown in FIGS. 1 and 3, the front rail 42 is positioned along the front edge 26 of shelf structure 12. Each of the side rails 44 are positioned along one of the side edges 30 of shelf structure 12.

Structure is provided for supporting the fence 40 at a spaced apart distance from the top surface 14 of the shelf structure 12. The support structure position at least a portion of the front rail 42 and a portion of each of the side rails 44 at a spaced apart distance from the top surface 14. The support structure includes a front support member 62 extending from the front rail 42. As best shown in FIG. 3, the front support member 62 terminates at a stop 64 which rests on the top surface 14. Two front support members 62 are shown. It is to be appreciated that any number of front support members 62 located at various portions of the fence 40 may be provided to position the fence 40 at a spaced apart distance from the top surface 14 of the shelf structure 12.

The enclosure structure 10 also includes structure for securing the fence 40 to the shelf structure 12. Structure is provided for restricting movement of the fence 40 relative to the shelf structure 12 in a direction parallel to the top surface 14. Structure is also provided for restricting movement of the fence 40 relative to the shelf structure 12 in a direction transverse to the top surface 14.

Referring now to FIGS. 1 and 3, the shelf structure 12 includes apertured portions 18 having apertures 20 in the top surface 14. The apertures 20 extend through the shelf structure 12 from the top surface 14 to the bottom surface 16, as is best shown in FIG. 3. Each of the apertures 20 define an aperture surface 22.

For restricting parallel movement of the fence 40, the fence 40 includes structure for engaging at least one of the aperture surfaces 22. Front support member 62 includes a tip 66 positionable in one of the apertures 20 and engageable with the aperture surface 22, as best shown in FIG. 2. The side rails 44,45 include at least one tab 54 extending from each of the distal ends 46 and positionable in one of the apertures 20 and engageable with the aperture surface 22 of the aperture.

For restricting transverse movement of the fence 40, at least one of the tabs 54 extends through one of the apertures 20 and away from the aperture wherein a portion of the tab 54 is positionable adjacent to and engageable with the bottom surface 16 of the shelf structure 12.

Figure 4:
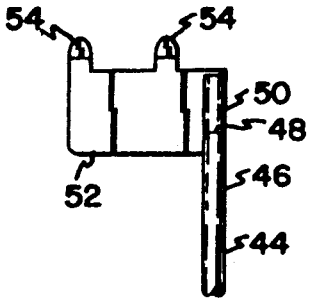
FIG. 4 is a top view of a portion of the enclosure structure shown in FIG. 2 taken along lines 4—4.

The structure for securing the fence 40 to the shelf structure 12 to prevent both parallel and transverse movement of the fence 40 relative to the top surface 14 includes two tabs 54 on both distal ends 46 which cooperates with the tips 66 extending from each front support member 62. Each of the tabs 54 includes a top portion 56 which rests on the top surface 14. A middle portion 58 of each tab 54 is engageable with the aperture surface 22. A tip portion 60 of each tab 54 is positionable adjacent to and engageable with the bottom surface 16 of the shelf structure 12. As best shown in FIG. 4, the tabs 54 extend from a plate 52. The plates 52 each attach to one of the distal ends 46 of the side rails 44.

Each of the distal ends 46 are provided with a rear support member 48. The rear support members 48 cooperate with the front support members 62 to position the fence 40 at spaced apart distances from the top surface 14. The rear support members include a bend 50 as shown in FIG. 3. Bend 50 is attachable to plate 52. The entire length of front rail 42 and side rails 44 are positioned at spaced apart distances from the top surface 14.

The shelf structure 12 can be made from a wide variety of different materials and be provided with a wide variety of different shapes. In the preferred embodiment, the planar portion 24 is formed from thin sheet material, such as sheet metal, with the apertures 20 formed through the shelf structure 12 by such processes as stamping. In the preferred embodiment, the apertures are diamond-shaped.

The enclosure structure 10 may be a one-piece structure. The enclosure structure 10 can be made from a variety of materials including such material as stainless steel. Fence 40, including front rail 42 and side rails 44 can be formed from a single piece of metal wire or rod bent into the U-shape. The distal ends 46 of the fence 40 may be bent or formed to form the rear support members 48 and bends 50. The front support members 62 may be bent from separate pieces of wire or rod and attached by welding or other attachment processes to the fence 40. Plates 52 with extending tabs 54 can be formed from metal into the appropriate shape by such process as stamping. The plates are attachable by welding or other processing to the bends 50 of the rear support members 48.

As shown in FIGS. 1 and 3, the enclosure structure 10 engages the shelf structure 12. In operation, the enclosure structure 10 and the top surface 14 of the shelf structure 12 cooperate to define a storage chamber adapted to receive objects for storage and display such as the containers 70.

One method for mounting the enclosure structure 10 to the shelf structure 12 is to place the enclosure structure 10 in a tilted orientation relative to the top surface 14 of the shelf structure 12 at a spaced apart distance from the top surface with the tabs 54 closer to the top surface than the stops 64 and tips 66. The enclosure structure 10 is then moved closer to the top surface until the tabs are each disposed within one of the apertures 20. The enclosure structure is then rotated generally about an axis located adjacent the engagement area between the tabs and the apertures wherein the stops and tips are moved toward the top surface until the stops engage the top surface and the tips are disposed within one of the apertures. In this position, the enclosure structure is securely mounted to the shelf structure.

Figure 5:
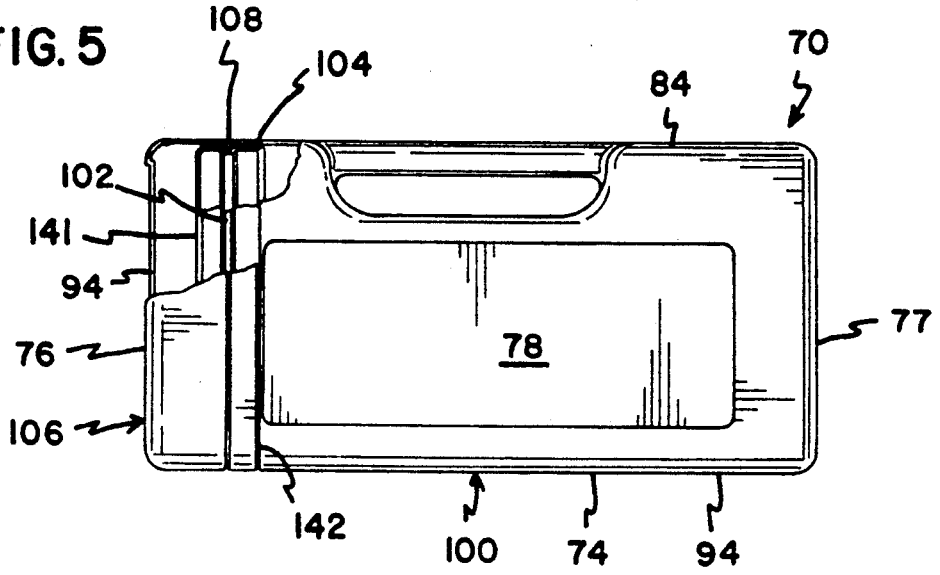
FIG. 5 is a side view in partial cross-section of one of the containers shown in FIGS. 1.

As best shown in FIGS. 1, 3, and 5, each container 70 includes a side wall 94 defining an enclosed chamber. In the embodiment shown, side wall 94 is relatively thin, approximately 0.03 to 0.06 inches. Side wall 94 may instead be relatively thick, and also include regions with non-uniform thicknesses. Side wall 94 defines a generally flat bottom surface 74, a front surface 76, a top surface 84, a back 77, and side surfaces 78 on opposite sides of the container. The containers 70 may be received by the storage chamber in single row relationship wherein the front surface 76 of each container 70 is adjacent to and engageable with the front rail 42 of the fence 40, as shown in FIG. 1. In the preferred embodiment, the bottom surface 74 of each container 70 is adjacent to and engageable with the top surface 14 of the shelf structure 12. The side surfaces 78 of each interior container 70 are adjacent to and engageable with the side surface of each adjacent container. The side surfaces of each end container 70 are adjacent to and engageable with the side surface of the adjacent interior container 70 on one side and one of the side rails 44 on the opposite side. Optionally, rear surface 77 defined by side wall 94 of the container 70 may engage a generally vertical portion of the shelf structure 12, as is illustrated in FIG. 3.

Referring now to FIG. 5, one of the containers 70 is shown in greater detail. Container 70 includes a body 100 which forms a portion of bottom surface 74, a portion of side surfaces 78, rear surface 77, and a portion of top surface 84. A separate lid 106 mounts to body 100 to form the enclosed chamber for receiving the length of chain.

Lid 106 mounts to body 100 with a projection 108 extending from lid 106 engageable with groove 102 of body 100. Projection 108 extends circumferentially around the inside surface of lid 106. Groove 102 extends circumferentially around the outside surface of body 100. A recess 104 circumferentially around body 100 permits flush mounting of lid 106 with body 100, as shown in FIG. 5. Body 100 of container 70 may be initially filled with chain prior to mounting lid 106 to body 100. Once lid 106 is mounted to body 100, container 70 is ready for shipping to the desired site for dispensing of chain.

In a preferred embodiment, container 70 is made from blow-molded plastic, such as high density polyethylene. Preferably, body 100 is integrally molded with lid 106. Following the molding process, lid 106 is separated from body 100. An edge 141 of lid 106 is joined to an edge 142 of body 100 through an intermediate piece (not shown) which is cut from edge 141 and edge 142 during the manufacturing process of container 70 to separate the lid from the body.

Figure 7:
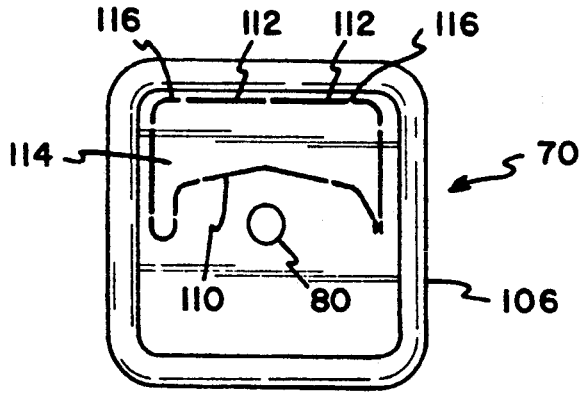
FIG. 7 is an end view of one of the containers shown in FIG. 1, showing the lid prior to removal of the cutout portion to form the opening.

Referring now to FIG. 7, an end view of container 70 is shown illustrating features of lid 106 in greater detail. During manufacturing, lid 106 may be made as integral structure except for opening 80. A die or other machine cuts a line 110 in the shape of the desired opening into container 70. Line 110 is not continuous. A plurality of connectors 116 separate cuts 112. Connectors 116 permit center portion 114 to remain with container 70 until center portion 114 is punched out from lid 106. In some cases, center portion 114 may need to be cut out at the connectors 116.

The structure of the center portion 114 and connectors 112 is advantageous during transport and handling of container 70 prior to dispensing chain from the interior. Center portion 114 keeps container 70 closed until chain dispensing is desired.

Once center portion 114 is removed from lid 106, opening 120 is created. Opening 120 comprises a first opening portion or main opening portion 122. Main opening portion 122 is larger than the widest part of the chain to be dispensed from the container, as the chain is withdrawn in a longitudinal direction from the container 70. Main opening portion 122 also permits chain to be put back into container 70 once the chain is removed.

As part of main opening portion 122, a crest or peak 124 is formed adjacent a midpoint of lid 106. Extending from peak 124 is a first sloped surface 126 and a second sloped surface 128. Sloped surfaces 126,128 slope toward first and second narrowed passages 130, 132, respectively. Sloped surfaces 126,128 provide structure for directing chain placed or dropped against one of the sloped surfaces toward one of the narrowed passages.

Narrowed passages, or slots 130,132 are provided as part of retaining structures 96,98 to prevent dispensing of chain from the interior of container 70 when a portion of the chain is positioned in one of the narrowed passages. In one preferred embodiment, narrowed passage 130 defines a U-shaped opening with sides 136 138 extending generally parallel to one another and parallel to a vertical axis (see FIGS. 8A and 8B). A U-shaped bottom 140 defines the lowermost point of narrowed passage 130 relative to the vertical in the preferred embodiment. U-shaped bottom 140 may be any shape such as linear in the horizontal direction, v-shaped, or some other curve shape other than the curve shown in the Figures.

U-shaped passage 130 is utilized for a variety of chains, especially large chains. During dispensing, chain is withdrawn from the interior of container 70 through main opening portion 122. After a sufficient length has been dispensed, an end portion of the remaining chain is positioned in U-shaped passage 130. U-shaped passage 130 limits the flow of chain from the interior of the container.

U-shaped passage 130 prevents chain in the interior of container 70 from further falling out of the container due to gravity pulling on the free end **82*b* of chain 82*a*, as shown in FIG. 1. This is particularly useful in maintaining unused chain in container 70** in an organized manner for future dispensing.

The shape of sloped surface 126 will tend to direct chain downward toward U-shaped passage 130 if the chain is merely positioned on sloped surface 126.

On an opposite side of lid 106 is narrowed passage 132 which defines a V-shaped opening. V-shaped passage 132 generally comprises first side 142, which intersects second side 144 at point 146 (see FIG. 8A and 8B). Point 146 may be a point or a small curved region or a small linear region extending in the horizontal direction. V-shaped passage 132 is useful, in particular, for smaller chains which may otherwise slide freely in U-shaped passage 130. V-shaped passage 132, like U-shaped passage 130, prevents chain in the interior of container 70 from falling out of the container due to the effects of gravity pulling on the free end 83*b* of chain 83*a*, as shown in FIG. 1.

The shape of sloped surface 128 will tend to direct chain downward toward V-shaped passage 132 if the chain is merely positioned on sloped surface 128.

Figure 8A:
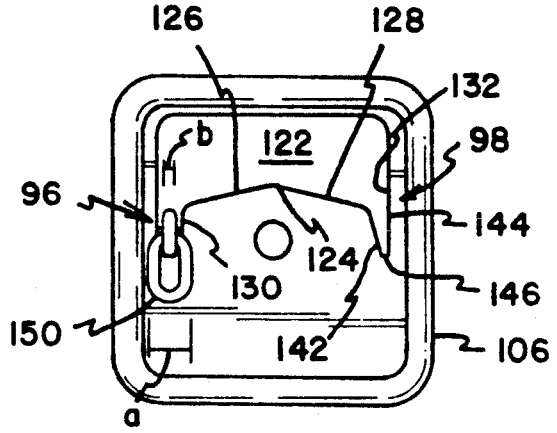
FIG. 8A is an end view of one of the container shown in FIG. 7, showing a first chain positioned in the first narrowed passage.
Figure 8B:
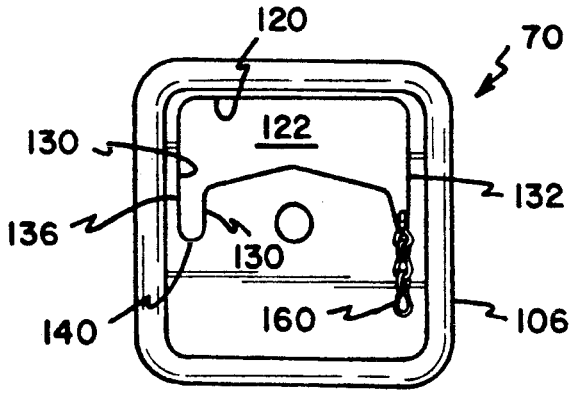
FIG. 8B is an end view of the container shown in FIG. 8A, showing a second chain positioned in the second narrowed passage.

Referring now to FIGS. 8A and 8B, use of narrowed passages 130, 132 is illustrated. In FIG. 8A, one type of chain, chain 150, is positioned in U-shaped passage 130. Chain 150 has a maximum outer diameter or dimension, labelled "a", and a minimum outer dimension, labelled "b". The outer dimension varies along the length of the chain 150. With respect to passages 130,132, a substantial length in the vertical direction of each of the passages 130,132 has a width narrower than dimension a of the chain to be dispensed, and wider than the narrowest dimension b of the chain to be dispensed. This permits limited flow of the chain being dispensed through passage 130,132.

U-shaped passage 130 has a vertical length extending downward in a generally vertical direction from main opening portion 122 a length sufficient to limit chain 150 from lifting upward toward main opening portion 122 to a position where U-shaped passage 130 would not obstruct the passage of the chain. Passage 130 has a substantial portion of which is narrower than the widest portion of the chain 150 and also wider than the narrowest portion of the chain 150 which flows through the opening 120 in the front surface 76 of container 70. Since the main opening 122 is wider than the widest part of the chain, passage 130 is spaced a sufficient distance from the main opening 122 such that chain 150 is retained in container 70 when an end portion of chain 150 passes through U-shaped passage 130. If the main opening 122 is too close to the passage 130, then retaining of chain 150 in container 70 may be inadequate.

Referring now to FIG. 8B, a different chain, chain 160, is shown positioned in V-shaped passage 132. Chain 160 has smaller links than chain 150. The surfaces 142,144 of V-shaped passage converge toward point 146, wherein chain 160 will move toward point 146 when chain 160 is positioned within V-shaped passage 132. Chain 160 is limited from flow through V-shaped passage 132 due to the configuration of sides 142, 144.

Chain 160 has a maximum outer dimension or diameter larger than a horizontal width of a portion of the slot formed between first side 142 and second side 144. Chain 152 further has a minimum outer dimension smaller than the horizontal width between first side 142 and second side 144. This permits V-shaped passage 132 to limit the flow chain 160 through V-shaped passage 132.

The V-shaped passage 132 has a length extending downward in a generally vertical direction from main opening portion 122 a length sufficient to bias chain 160 against lifting upward toward main opening to a position where V-shaped passage 132 would not obstruct the passage of the chain. Passage 132 has a substantial portion of which is narrower than the widest portion of the chain 160 and also wider than the narrowest portion of the chain 160 which flows through the opening in the front surface 76 of container 70. To achieve adequate retaining of chain 160 sides 142,144 are fairly steep, or may be vertical.

A narrowing of V-shaped passage 132 in the vertical downward direction permits chain of variable diameters to be adequately retained in V-shaped passage 132.

To begin further dispensing of chains 150,160, the chain may be lifted upwardly from the respective narrowed passages 130,132 into main opening portion 122. Once chain 150,160 is sufficiently in main opening portion 122, the chain passes freely for dispensing.

In the preferred embodiment, container 70 is provided with a small opening 80 passing through the front surface 76 and providing access into the interior of container 70. This is useful for removing lid 106 from mounted engagement with body 100 by sticking a finger into hole 80 and pulling them apart. Lid 106 may be removed for a variety of reasons, such as to refill container 70 once emptied or to find the free end of the chain should it inadvertently not be reachable by the user of container 70 though opening 120. Small opening 80 may be a result of integrally blow molding lid 106 and body 100.

The configuration of lid 106 provides sufficient access to the interior of container 70, yet lid 106 is sufficiently rigid to maintain the appropriate shape of the container 70 during use and handling. Further, narrowed passages 130,132 each have a bottom-most point which is sufficiently high relative to the rest of container 70 to permit a portion of the chain to fall to be retained in one of the narrowed passages even when a relatively large amount of chain remains in the container 70. If narrowed passages 130,132 are too low relative to the amount of chain in the container, the chain remaining in container may be so high as to prevent the end of the chain from sufficiently falling into the narrowed passages to limit flow.

An example of lid 106 with opening 120 may include narrowed passage 130 having vertical sides 136,138 extending for approximately 0.75 inches, spaced apart by approximately 0.44 inches. U-shaped bottom 140 is a full radius. Side 138 may extend from U-shaped bottom 140 to a corner formed by an approximately 0.25 inch radius curve. Side 144 of V-shaped passage 132 may be vertical. Side 142 may extend from point 146 spaced apart from side 144 approximately 0.12 inches. Side 142 may extend at approximately a 20 degree angle from the vertical. Side 142 may extend a vertical distance of approximately 0.75 inches where an approximately 0.25 inch radius curve forms a corner.

As best shown in FIGS. 3 and 5, each of the containers 70 includes the top surface 84 providing a handle for easy handling of the containers 70. In the preferred embodiment, the handle is formed by a U-shaped depression 86 in the top surface 84 of the container 70 having opposing side portions 88. A bar member 90 connects the opposing side portions 88,89 to form a handle 90 sized to be grasped by a person's hand for easy handling from one location to another. Bar member 90 may be made hollow during manufacturing. To strengthen the handle in the case of containing heavy chains, an insert may be positioned in the hollow bar member 90 to keep the bar member from bending.

Figure 6:
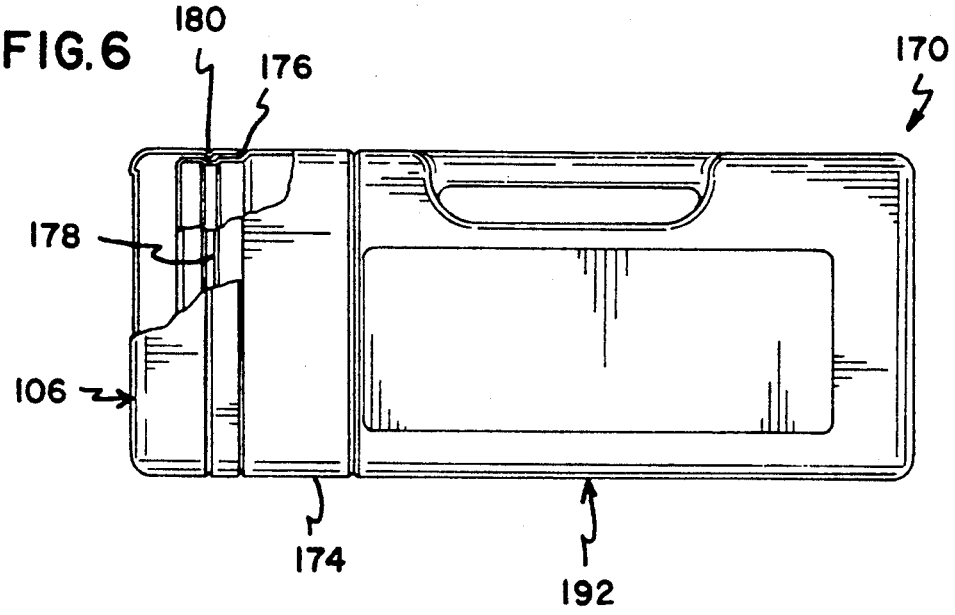
FIG. 6 is a side view in partial cross-section of a second embodiment of a container useful in the system of FIG. 1.

It is to be appreciated that containers 70 can be provided with a variety of different shapes and dimensions other than illustrated in FIGS. 105. FIG. 6 illustrates a second preferred embodiment of a container 170. Container 170 is useful with lid 106 described previously. Container 170 includes a body 172 with an extension 174. A recess 176 and groove 178 are similar to recess 104 and groove 102 of container 70. A projection 108 on lid 106 engages groove 178 of body 172 to form the enclosed chamber for receiving chain in container 170.

Figure 9:
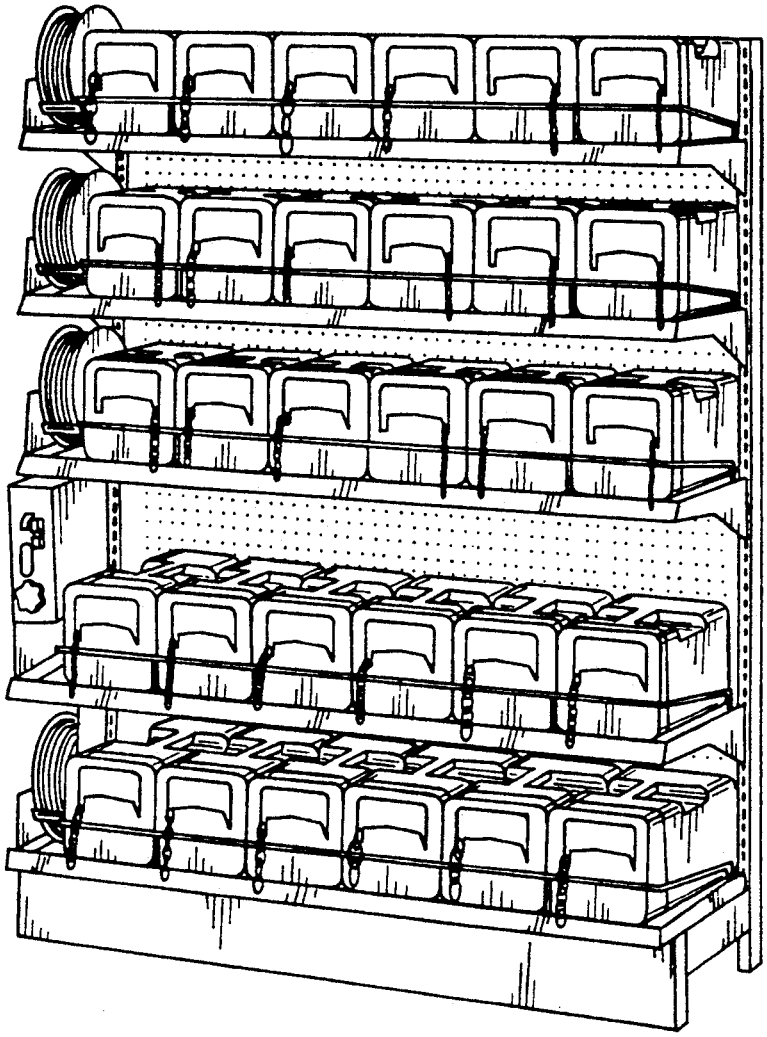
FIG. 9 shows a plurality of containers of the type shown in FIG. 1, with different chains being dispensed from the containers.
Figure 10A:
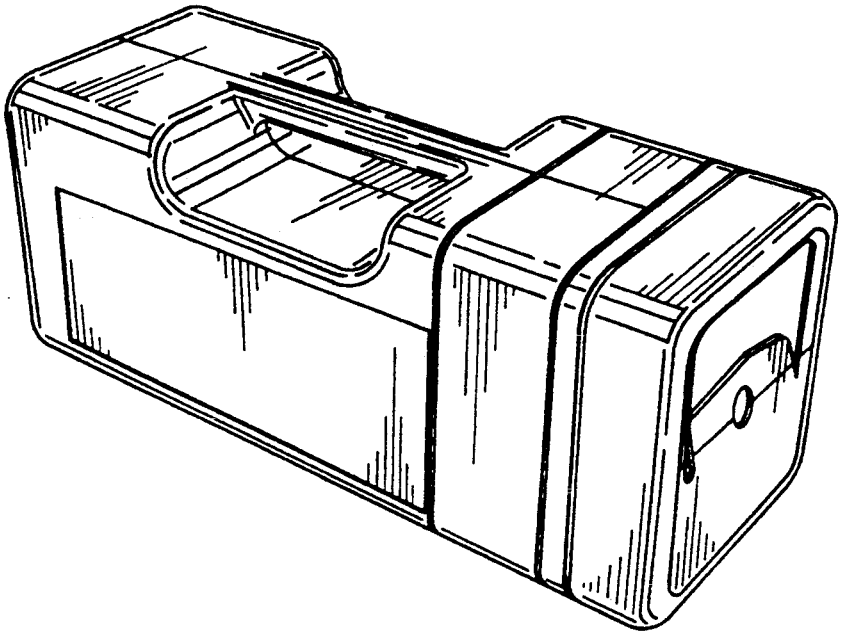
FIGS. 10A–E show various views of a container of the type shown in FIG. 1.
Figure 10B:
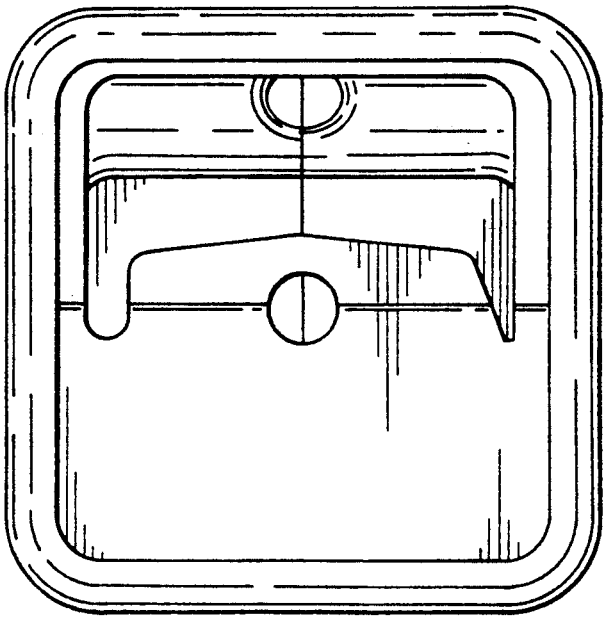
Figure 10C:
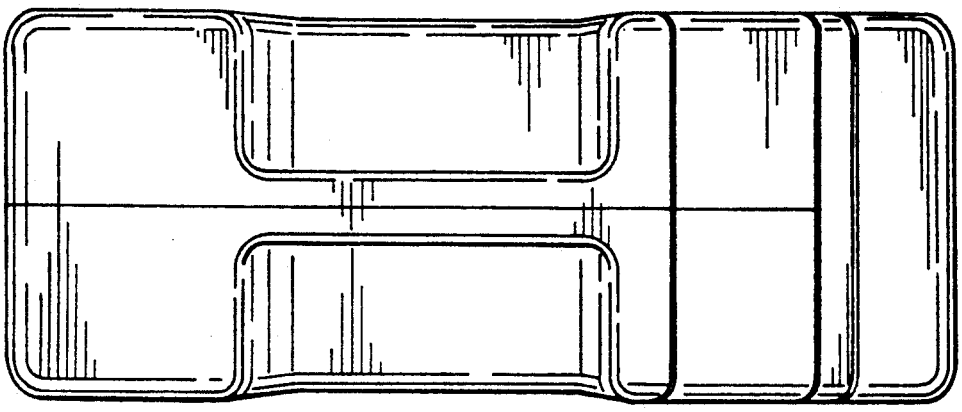
Figure 10D:
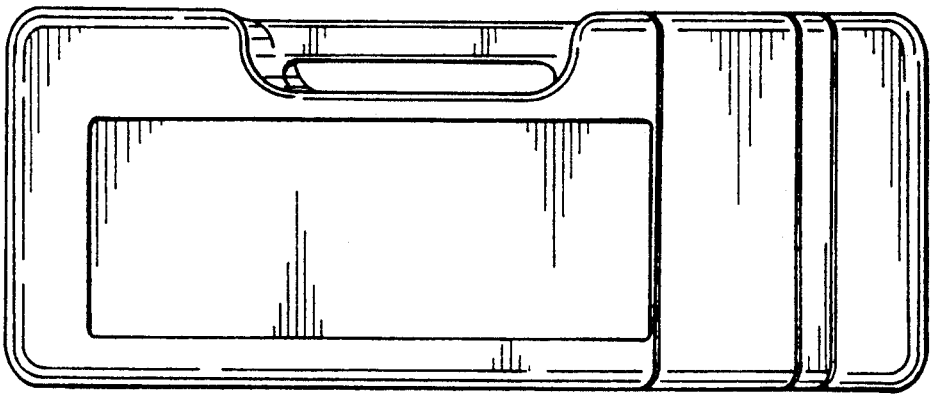
Figure 10E:
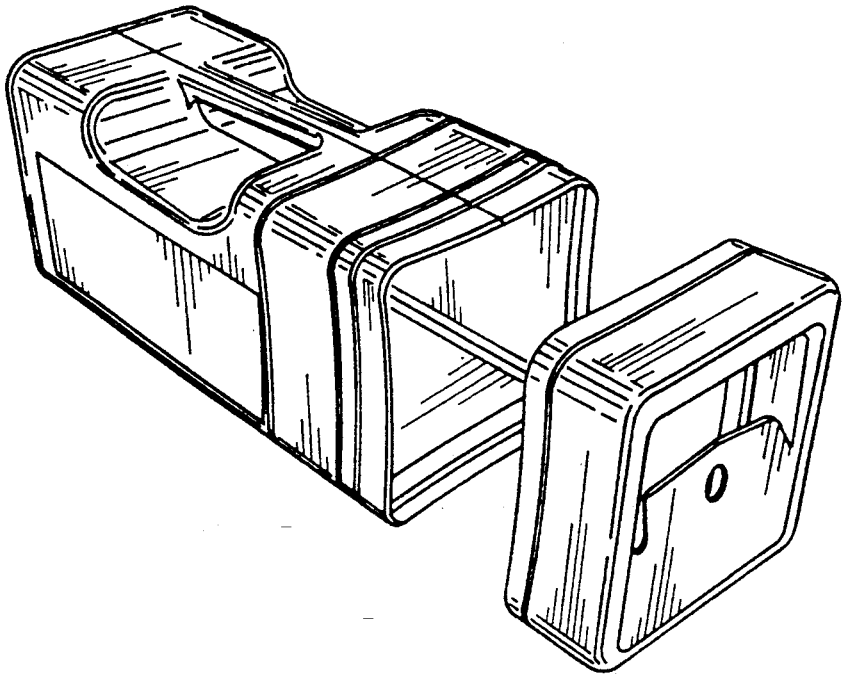

FIG. 9 shows a plurality of containers like container 70. Various different types of chains are being stored and retained in the containers of FIG. 9. FIG. 10 shows various view of a container like container 270.

It is to be understood that, even though numerous characteristics and advantages of the invention have been set forth in the foregoing description, together with details of the structure and function of the invention, the disclosure is illustrative only, and changes may be made in detail, especially in matters of shape, size, and arrangement of the parts within the principles of the invention to the full extent indicated by the broad general meaning of the terms in which the appended claims are expressed. For example, the number of slots may be more or less than two, and the particular shape of the slots may vary from the U- or V-shaped configurations described herein, yet still come within the scope of the invention.

What is claimed is:

1. A system for containing and dispensing chain comprising:

(a) a plurality of containers, each container including:
  (i) a body with a bottom and a top;
  (ii) a lid;
  (iii) means for mounting said lid to said body to define an enclosed chamber for receiving a lengt of chain;
  (iv) said lid including a first opening portion into said enclosed chamber, said first opening portion defining a passageway permitting dispensing of the length of chain from the enclosed chamber;
  (v) said lid further including a second opening portion into said enclosed chamber, said first opening portion and said second opening portion connected with each other, said second opening portion defining a passageway sized to limit the flow of the length of chain from said enclosed chamber; and
  (vi) said lid further including a third opening portion into said enclosed chamber, said third opening portion defining a passageway sized for limiting the flow of a second length of chain, said third opening portion connected with said first opening portion, and said third opening portion being disposed on an opposite side of said lid relative to said second opening portion, and said third opening being disposed vertically below said first opening portion, wherein said third opening portion defines a different shape than said second opening portion;

(b) a shelf having a generally planar portion with a top surface;

(c) a fence extending from said shelf and cooperating with said shelf to define a compartment for receiving said plurality of containers; and (d) said containers positioned on said shelf in said compartment wherein said bottom surface of each of said containers rests on said top surface of said shelf, and said first opening portion is vertically disposed above said second opening portion.

2. The container of claim 1, wherein said second opening portion defines a U-shaped passage, and wherein said third opening portion defines a V-shaped passage.

3. The system of claim 1, wherein said first opening portion includes two partially vertically sloped surfaces sloping from said first opening portion to each of said second and third opening portions, with one sloped surface sloping toward said second opening portion and the other of said sloped surfaces sloping toward said third opening portion, said sloped surfaces intersecting at a peaked portion, said peak portion disposed vertically above said second and third opening portion.

4. A container for containing and dispensing chain comprising:

(a) a side wall defining an enclosed chamber for receiving a length of chain;

(b) said side wall defining a first opening portion sized to permit the free passage of chain positioned in said first opening portion;

(c) said side wall defining a second opening portion in communication with said first opening portion, said second opening portion sized to prevent the free passage of said chain positioned in said second opening portion, said second opening portion defining a U-shaped slot with generally vertical sides and terminating in a curved bottom, said curved bottom being vertically disposed below said first opening portion;

(d) said side wall defining a third opening portion in communication with said first opening portion, said third opening portion sized to prevent the free passage of said chain, said third opening portion defining a V-shaped slot with a first generally vertical side and an angled side converging toward a point and each of said sides terminating at a bottom point, each of said bottom points being vertically disposed below said first opening portion, said third opening portion being disposed on an opposite side of said lid relative to said second opening portion;

said first opening portion including two partially vertically sloped surfaces sloping from said first opening portion to each of said second and third opening portions, with one of said sloped surface sloping toward said second opening portion and the other of said sloped surfaces sloping toward said third opening portion, said sloped surfaces intersecting at a peak, said peak disposed vertically above said second and third opening portions.

5. A container for dispensing a length of chain, said container comprising:

a continuous side wall defining an enclosure, said side wall including a front face, said continuous side wall having a plurality of interconnected edges which cooperate to define an opening in said front face, said opening having a plurality of opening portions which combine to form said opening, each opening portion being at least partially defined by at least one of said plurality of interconnected edges, said opening having a first opening portion through which the length of chain can pass freely and second and third opening portions separately communicating with said first opening portion; wherein said second opening portion is at least partially defined by first and second converging edges, each of which is a straight edge, such that the respective first and second straight edges define a V-shaped portion of said second opening portion which is increasingly truncated as it extends away from said first opening portion and is sufficiently truncated to restrain passage of the length of chain through said second opening portion when the length of chain is resting upon both of said first and second straight edges of said Vshaped portion; wherein said third opening portion is at least partially defined by a third edge which is generally U-shaped; and wherein said second and third opening portions are separate portions of said opening interconnected only by said first opening portion and wherein said second and third opening portions are located on opposite sides of said front face.

6. The container of claim 5, wherein said second opening portion and said third opening portion are separated by a fourth edge which forms a portion of said first opening portion, said fourth edge defining a peak and two sloped edge portions on either side of said peak.

7. A system for containing and dispensing chain comprising:

(a) a plurality of containers, each container including:

(i) a body having a bottom and a top;

(ii) a lid;

(iii) means for mounting said lid to said body to define an enclosed chamber for receiving a length of chain; wherein said lid includes an opening into said enclosed chamber including a first opening portion, said first opening portion defining a passageway permitting dispensing of the length of chain from said enclosed chamber; and said opening further including a second opening portion into said enclosed chamber, said first opening portion and said second opening portion interconnected with each other, said second opening portion defining a passageway sized to limit the flow of the length of chain from said enclosed chamber; wherein said opening includes a third opening portion defining a passageway sized for limiting the flow of a second length of chain, said third opening portion interconnected with said first opening portion, and said third opening portion being disposed on an opposite side of said lid relative to said second opening portion, wherein said second opening portion defines a U-shaped passageway, and wherein said third opening portion defines a V-shaped passageway.

(b) a shelf having a generally planar portion with a top surface; and (c) a fence disposed at least partially above said top surface and extending into a plane above said top surface, said fence at least partially defining a compartment; wherein said containers are positioned within said compartment, wherein said first opening portion is vertically disposed above said second opening portion and said third opening portion in a generally vertical plane.

8. The system of claim 7, wherein said first opening portion is at least partially defined by first and second vertically sloped edges sloping from said first opening portion to each of said second and third opening portions, with one sloped edge sloping toward said second opening portion and the other of said sloped edges sloping toward said third opening portion, said sloped edges intersecting at a peak disposed vertically above said second and third opening portions when the respective container is within said compartment.

9. A system for containing and dispensing chain comprising:

a plurality of containers, each container including a continuous side wall defining an enclosure, said continuous side wall including a front face, said continuous sidewall having a plurality of interconnected edges in said front face which cooperate to define an opening through which the length of chain can pass, said opening having a plurality of opening portions which combine to form said opening, each opening portion being at least partially defined by at least one of said plurality of interconnected edges; said opening having a first opening portion, through which the length of chain can pass freely, and a second opening portion communicating with said first opening portion, wherein said second opening portion is at least partially defined by first and second converging edges, each of which is a straight edge, such that the respective first and second converging edges define a V-shaped portion of said second opening portion which is increasingly truncated as it extends away form said first opening portion and is sufficiently truncated to restrain passage of the length of chain through said second opening portion when the length of chain is resting upon both of said first and second converging edges of said V-shaped portion, said first opening portion including a sloped edge interconnected to said first converging edge, said sloped edge sloping toward said second opening portion, said sloped edge descending at a slower rate relative to said first converging edge;

a shelf having a generally planar portion with a top surface;

a fence disposed at least partially above said top surface and extending into a plane above said top surface, said fence at least partially defining a compartment; wherein said containers are positioned within said compartment, and said first opening portion is vertically disposed above said second opening portion in a generally vertical plane; and a length of chain having a width sized to pass freely through said first opening portion when said length of chain is positioned in said first opening portion, said width of said length of chain sized to be restrained by said second opening portion when said length of chain is disposed between said first and second converging edges.

10. The system of claim 9, wherein said opening includes a third opening portion, wherein said third opening portion is at least partially defined by a third edge which is generally U-shaped; and wherein said second and third opening portions are separate portions of said opening which separately communicate with said first opening portion, said first opening portion including a second sloped edge interconnected to said third edge, said second sloped edge sloping toward said third opening portion, said third opening portion sized to restrain said length of chain or another length of chain having a different width than said length of chain, said width of said another length of chain sized to pass freely through said first opening portion.

11. A container for dispensing a length of chain, said container comprising:

a side wall defining an enclosure with a front face;

said side wall having edges defining an opening for dispensing the length of chain, said opening including a first opening portion, said first opening portion sized to permit the free passage of the length of chain from within said enclosure;

said side wall having further edges defining a second opening portion of said opening, said second opening portion being interconnected to said first opening portion, said second opening portion having a substantial length having a horizontal dimension wider than a smallest width of the length of chain, and narrower than a largest width of the length of chain;

said side wall having further edges defining a third opening portion of said opening, said third opening portion being interconnected to said first opening portion, said third opening portion having a substantial length having a horizontal dimension wider than a smallest width of a second length of chain, and narrower than a largest width of the second length of chain, wherein said second opening portion and said third opening portion have different shapes; wherein said second opening portion and said third opening portion are disposed on opposite sides of said front face, and wherein said second opening portion and said third opening portion are disposed vertically below said first opening portion.

12. The container of claim 11, wherein said second opening portion defines a U-shaped passage, and wherein said third opening portion defines a V-shaped passage.

13. The container of claim 11, wherein said side wall defines a sloped edge proximate said first opening portion, said sloped edge sloping downwardly to said second opening portion.

14. A system for dispensing a length of chain, said system comprising:

a container having a sidewall defining an enclosure for receiving the length of chain;

said container having a front surface, said front surface having an inner edge defining an opening passing through said front surface and communicating with said enclosure, said opening including a chain removal portion through which the length of chain can be removed from said enclosure, wherein a first portion of said inner edge partially defines a first chain restraining portion of said opening interconnected with said chain removal portion thereof, said first portion of said inner edge including first chain restraining means for restraining the length of chain from general horizontal movement through said opening when said front surface is in a generally vertical plane and said chain rests otherwise unsupported upon elements of said first portion of said inner edge, said first chain retaining means including first and second segments of said first portion of said inner edge which join together to generally form a V-shaped edge which narrows as it becomes further removed from a general center of said opening, wherein a second portion of said inner edge partially defines a second chain restraining portion of the opening interconnected with said chain removal portion thereof, said second portion of the inner edge including second chain retaining means for restraining the length of chain from general horizontal movement through said opening when said front surface is in said generally vertical plane and said chain rests otherwise unsupported upon elements of said second portion, said second chain retaining means including first and second segments of said second portion of said inner edge which join together to generally form a U-shaped edge having generally vertical nd parallel sides in portions thereof, said first and second chain restraining portions of said opening being separately interconnected with said chain removal portion of said opening, said first and second chain restraining portions being located on opposite sides of said front surface.

15. A system for dispensing a length of chain, said system comprising:

a container having a sidewall defining an enclosure for receiving the length of chain;

said container having a front surface, said front surface having an inner edge defining an opening passing through said front surface and communicating with said enclosure, said opening including a chain removal portion through which the length of chain can be removed from said enclosure, wherein a first portion of said inner edge partially defines a first chain restraining portion of said opening interconnected with said chain removal portion thereof, said first portion of said inner edge including first and second segments of said inner edge which generally form a V-shape which narrows as it becomes further removed from said chain removal portion of said opening to define at least a portion of said first chain restraining portion, wherein said inner edge includes a second portion thereof defining a second chain restraining portion of said opening interconnected with said chain removal portion thereof, said second portion of said inner edge including third and fourth segments of said inner edge which generally form a channel-shape having generally parallel sides and a bottom disposed at an end of said channel-shape which is furthest removed from said chain removal portion of said opening to define at least a portion of said second chain restraining portion, said first portion of said inner edge and said second portion of said inner edge being located on opposite sides of said front surface.

16. A system for dispensing a length of chain, said system comprising:

a container having a sidewall defining an enclosure for receiving the length of chain; said sidewall having a front face, said front face having a plurality of interconnected edges defining an opening having a plurality of opening portions which combine to form said opening, each opening portion being at least partially defined by at least one of said plurality of interconnected edges, said opening having a first opening portion through which the length of chain can pass freely, and a second opening portion communicating with said first opening portion, wherein said second opening portion is at least partially defined by first and second edges, said first and second edges spaced apart to receive the length of chain and to restrain passage of the length of chain through said second opening portion when the length of chain is disposed between said first and second edges, wherein said first opening portion is vertically disposed above said second opening portion, said first opening portion including a first sloped edge interconnected to said first edge of said second opening portion, said first sloped edge sloping toward said second opening portion, said first sloped edge descending at a slower rate relative to said first edge; and a length of chain having a width sized to pass freely through said first opening portion when said length of chain is positioned in said first opening portion, said width of said length of chain sized to be restrained by said second opening portion when said length of chain is disposed between said first and second edges.

17. The system of claim 16, wherein said opening has a third opening portion communicating with said first opening portion, wherein said third opening portion is at least partially defined by third and fourth edges, said third and fourth edges spaced apart to receive said length of chain or another length of chain different from said length of chain and to restrain passage of said length of chain or said another length of chain through said third opening portion when said length of chain or said another length of chain is disposed between said third and fourth edges, said another length of chain having a different width than said length of chain and said another length of chain sized to pass freely through said first opening portion, said second opening portion and said third opening portion disposed on opposite sides of said front face, said first opening portion vertically disposed above said third opening portion, said first opening portion including a second sloped edge interconnected to said third edge of said third opening proton, said second sloped edge sloping toward said third opening portion, said second sloped edge descending at a slower rate relative to said third edge, said first sloped edge intersecting said second sloped edge at a peaked portion vertically disposed above said second opening portion and said third opening portion.

18. The system of claim 17, wherein said second opening portion defines a different shaped opening relative to said third opening portion.

19. The system of claim 18, wherein said first and second edges of said second opening portion cooperate to define a V-shaped opening and said third and fourth edges of said third opening portion cooperate to define a U-shaped opening.

20. The system of claim 19, wherein said front face is disposed in a generally vertical plane.

21. The system of claim 16, wherein said first and second edges of said second opening portion cooperate to define a V-shaped opening.

22. The system of claim 16, wherein said first and second edges of said second opening portion cooperate to define a U-shaped opening.

* * * * *

UNITED STATES PATENT AND TRADEMARK OFFICE

CERTIFICATE OF CORRECTION

PATENT NO. : 5,293,998

DATED : March 15, 1994

INVENTOR(S) : Richard A. George

It is certified that error appears in the above-identified patent and that said Letters Patent is hereby corrected as shown below:

At Col. 3, line 51, "position" should read --positions--.

At Col. 7, lines 31,32, "passage" should read --passages--.

At Claim 1, Col. 9, line 39, "lengt" should read --length--.

At Claim 5, Col. 11, line 12, "Vshaped" should read --V-shaped--.

At Claim 9, Col. 12, line 31, "form" should read --from--.

At Claim 14, Col. 14, Line 11, "nd" should read --and--.

At Claim 17, Col. 16, line 7, "proton" should read --portion--.

Signed and Sealed this

Thirtieth Day of August, 1994

*Attest:*

*Attesting Officer*

Bruce Lehman

BRUCE LEHMAN

*Commissioner of Patents and Trademarks*